United States Patent [19]

Nasatka

[11] Patent Number: 4,826,349

[45] Date of Patent: May 2, 1989

[54] UNDERGROUND VEHICLE BARRICADE

[76] Inventor: Ralph G. Nasatka, 8405 Dangerfield Pl., Clinton, Md. 20735

[21] Appl. No.: 93,203

[22] Filed: Sep. 4, 1987

[51] Int. Cl.[4] ..... E01F 13/00

[52] U.S. Cl. ..... 404/6; 49/33; 49/49; 49/131

[58] Field of Search ..... 404/6, 9–11; 49/31, 33, 49, 131; 14/71.1, 71.3, 71.7

[56] References Cited

U.S. PATENT DOCUMENTS

| | | | |
|---|---|---|---|
| 1,649,877 | 11/1927 | Walston | 404/6 X |
| 1,949,295 | 2/1934 | Dean | 49/49 X |
| 2,714,735 | 8/1955 | Watson | 14/71.7 |
| 3,626,638 | 12/1971 | Lafferty | 49/131 X |
| 3,805,448 | 4/1974 | Carr et al. | 49/49 |
| 4,152,871 | 5/1979 | Kardash, Jr. | 49/49 |
| 4,354,771 | 10/1982 | Dickinson | 404/6 |
| 4,455,703 | 6/1984 | Fromme et al. | 14/71.3 |
| 4,490,068 | 12/1984 | Dickinson | 404/6 |
| 4,574,523 | 3/1986 | Nasatka | 49/49 |
| 4,624,600 | 11/1986 | Wagner et al. | 404/6 |
| 4,627,763 | 12/1986 | Roemer et al. | 404/6 |
| 4,705,426 | 11/1987 | Perea | 404/6 |

FOREIGN PATENT DOCUMENTS

| | | | |
|---|---|---|---|
| 3134247 | 3/1983 | Fed. Rep. of Germany | 49/49 |
| 2586127 | 2/1987 | France | 404/6 |
| 1261704 | 1/1972 | United Kingdom | 49/49 |

*Primary Examiner*—Jerome W. Massie
*Assistant Examiner*—John F. Letchford
*Attorney, Agent, or Firm*—Shlesinger & Myers

[57] ABSTRACT

A vehicle barricade comprises a frame having an open top and bottom, side, front and rear portions. A barrier plate is pivotally associated with the frame for being pivoted between a first and a second position. A cylinder and piston assembly pivots the barrier plate between the positions. A first stop extends from and is carried by the barrier plate. A second stop is connected to the frame and is engageable with the first stop for preventing said barrier plate from pivoting beyond said second position. A plurality of tubes extend forwardly from the front portion and prevent the frame from moving in the event the barrier plate is impacted by a vehicle.

21 Claims, 3 Drawing Sheets

B
R
18
10
30
28
34
32
54
26
50
52
36
24
14
68
78
38
39
80
40
82
12
74
C
F
16
88
86
20
22

UNDERGROUND VEHICLE BARRICADE

BACKGROUND OF THE INVENTION

A vehicle barricade is a device which is disposed across a roadway in order to control passage along the roadway. The barricade normally has a barrier plate which is pivotal between a first lowered position, permitting passage along the roadway, and a second raised position, preventing passage. Naturally, there are suitable operating mechanisms, such as hydraulic cylinder and piston assemblies, for pivoting the barrier plate between the positions. An illustrative aboveground barricade is illustrated in my prior U.S. Pat. No., 4,574,523, for Vehicle Barricade or Maximum Security Barrier, issued Mar. 11, 1986.

My prior above cited patent discloses an aboveground barricade suitable for many installations. Some locations, on the other hand, may not wish to have an above-ground barricade for aesthetic or structural reasons. Belowground barricades are known, but most require extensive preparatory excavation and do not adequately withstand the impact force of the onrushing vehicle.

Those skilled in the art understand that there is a need for a belowground barricade which can be installed with minimal amount of excavation, in a minimal time period, and which assures positive transfer of the impact forces to the barricade structure in order to assure integrity of the barrier plate upon impact. The disclosed underground barricade is one meeting these criteria and which is of lightweight construction while retaining maximum strength.

OBJECTS AND SUMMARY OF THE INVENTION

The primary object of the disclosed invention is an underground vehicle barricade which may be installed with minimal excavation, which has a lightweight barrier plate to permit relatively easy pivoting between the positions, and which has means for effectively transferring the impact forces from the barrier plate to the barricade and surrounding terrain.

A vehicle barricade according to the invention comprises frame means having an open top, and bottom, side, front and rear portions. A barrier plate is pivotally associated with the frame means for being pivoted between a first position overlying the top and a second position angularly upwardly disposed relative to the top. Means are operably associated with the plate for pivoting the plate between the raised and lowered positions. First stop means extend from and are carried by the plate and are engageable with second stop means associated with the frame for preventing the plate from pivoting beyond the second position and for assuring transfer of impact forces from the plate to the frame means. Stabilizer means extend forwardly from the front portion and prevent the frame means from moving in the event the plate is impacted by an onrushing vehicle.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
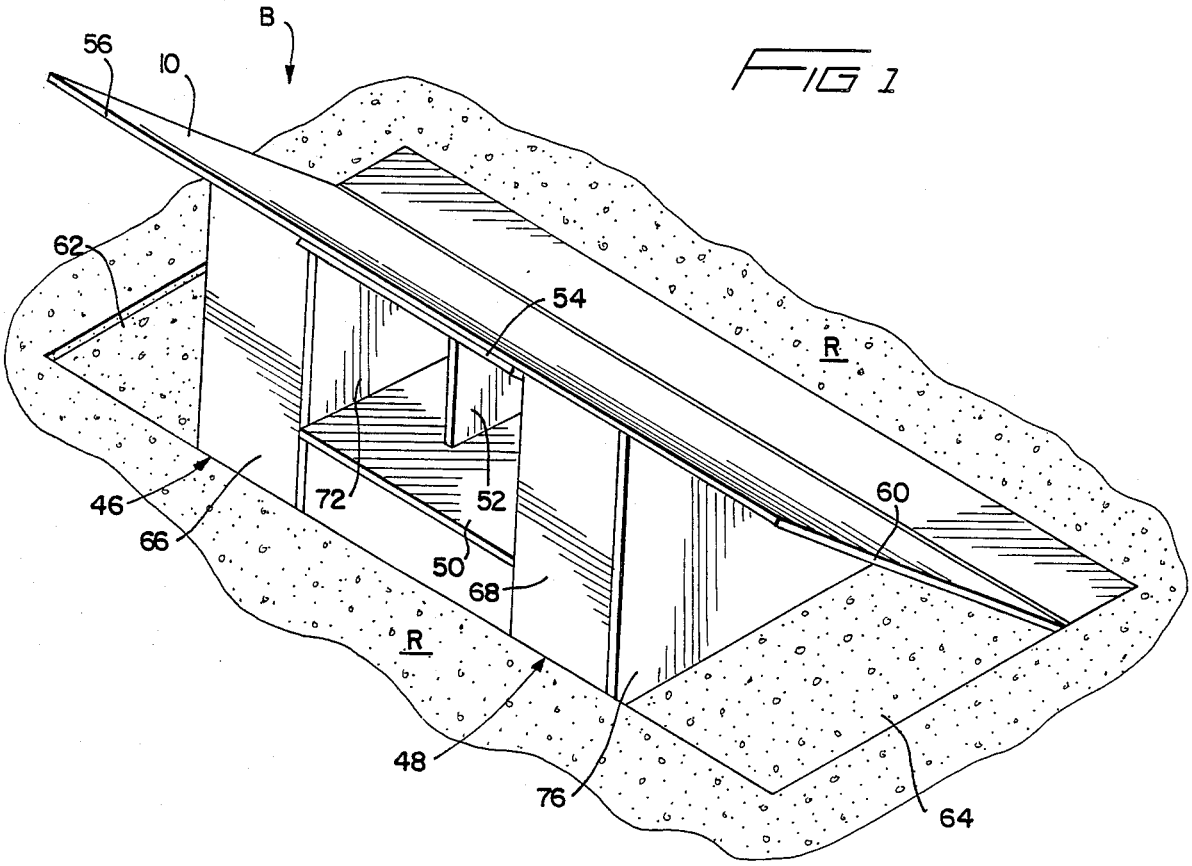
FIG. 1 is a perspective view of the barricade of the invention with the barrier plate in the raised position.
Figure 3:
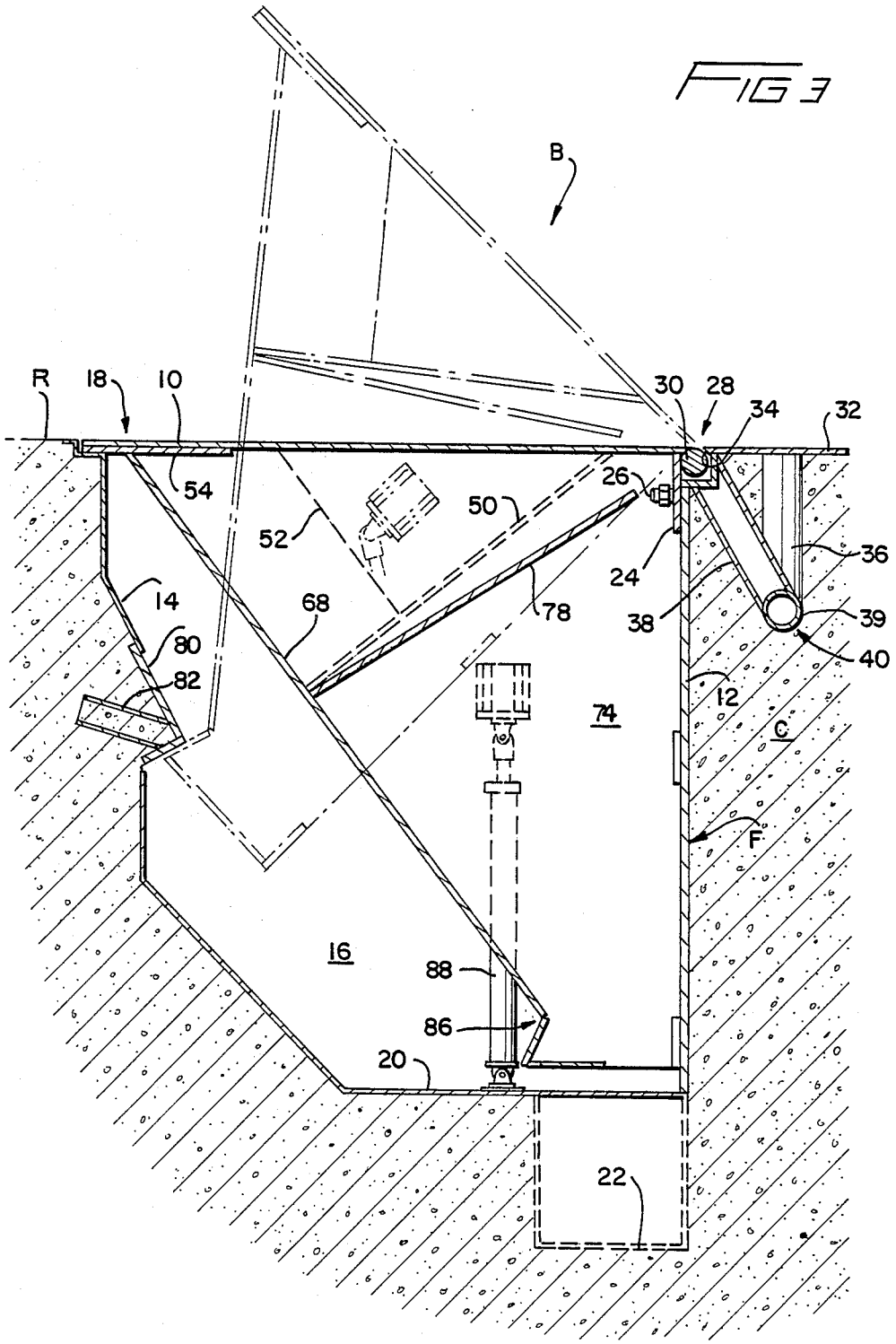
FIG. 3 is a cross-sectional view taken along the section 3—3 of FIG. 4.

Barricade B, as best shown in FIGS. 1 and 3, is disposed across roadway R for selectively interdicting traffic moving along the roadway R. The barricade B is an underground barricade and barrier plate 10 is parallel to and aligned with roadway R when in the lowered position, as best shown in FIG. 3, and may be pivoted into the raised or blocking position illustrated in FIG. 1.

Those skilled in the art understand that the barricade B must be able to withstand the impact of an onrushing vehicle. For this reason, it is important that the barricade B be firmly secured below the roadway R and in the surrounding terrain. Otherwise, impact with the barrier plate 10 could permit the barricade B to be ripped from the ground and thereby be rendered unusable. Furthermore, it is important that the barrier plate 10 transfer the impact forces to some solid structure in order to withstand the impact.

I have found that adequate support of the barricade B can be achieved by anchoring the barricade B in an excavated site or pit filled with concrete C. The pit can be kept relatively small and thereby be excavated in a relatively short period of time. The concrete C adds substantially to the mass of the barricade B and helps to anchor the barricade B into the surrounding terrain. Various types of concrete may be used with the invention, it merely being necessary that the concrete C add sufficient mass and be of sufficient strength.

I prefer that a metallic frame F, defining a chamber, be positioned within the concrete C for anchoring the barricade B therein and likewise for permitting rapid installation of the barricade B. The frame F has a rear wall portion 12, a front wall portion 14, and side portions, only the side portion 16 being shown in FIG. 3. Also, the frame F has an open top IB which is covered by barrier plate 10 when in the lowered position, and a bottom wall 20 with a drainage sump 22. The use of metallic frame F permits rapid installation because the frame F may be dropped into position after the excavation is completed and the concrete C merely poured thereabout. This minimizes installation time, thereby permitting the barricade B to be operable in a relatively short period of time.

Angle 22 is secured to rear wall portion 12 and to plate 24. Plate 24 may be bolted to rear wall portion 12, such as by bolt 26, or otherwise secured thereto. The angle 22 forms a U-shaped channel with the plate 24 which is open along the top 28 thereof. Shaft 30 is positioned within the channel and is secured to the barrier plate 10, such as by welding, and shaft 30 defines a pivot axis for the plate 10.

Base plate 32 is secured to angle 22 and extends rearwardly therefrom. Plate 32 has a forward edge portion 34 which overlies top 28 and shaft 30 and prevents the shaft 30 from being removed from the channel. In this way, I insure that the barrier plate 10 Cannot be removed from its overlying relation to top 18, except when authorized.

The angle 22 and base plate 32 are anchored to concrete C, as best shown in FIG. 3. Downwardly extending pipes 36 are welded to base plate 32. Angularly downwardly extending pipes 38 are welded to angle 22 and are interconnected through brace 39 with the pipes 36 to form a plurality of C-shaped anchor assemblies 40. The concrete C thereby surrounds the anchor assemblies 40 and prevents movement of base plate 32 and angle 22. Furthermore, the pipes 38 are generally angularly aligned with barrier plate 10 when the plate 10 is in the raised position so that the impact force is thereby transferred from the plate 10 through shaft 30 and angle 22 to the anchor assemblies 40. The impact forces are, thereby, absorbed and the integrity of barrier plate 10 maintained.

Figure 5:
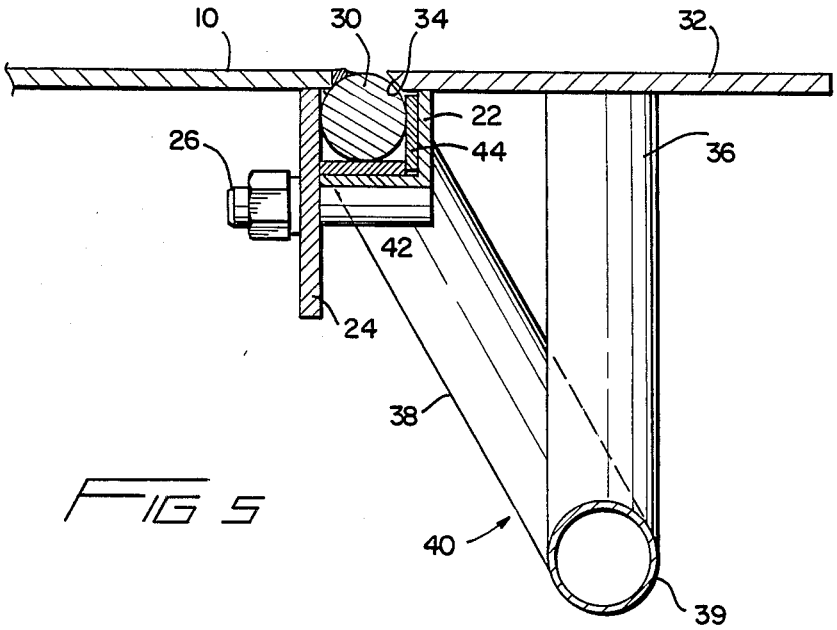

FIG. 5 illustrates an anchor assembly 40 in conjunction with the angle 22 and the plate 10. It can be noted that shims 42 and 44 are positioned within angle 22 to properly align the shaft 30 to assure proper pivoting of the plate 10.

Segment assemblies 46 and 48 are secured to barrier plate 10 and extend downwardly therefrom, as best shown in FIG. 1. A central plate 50 extends laterally between and is secured to the segment assemblies 46 and 48 and is sufficiently closely spaced from roadway R, when the barrier plate 10 is in the second position, to prevent access to the internals of the barricade B. A center upright plate 52 is secured to and extends vertically between barrier plate 10 and central plate 50. A reinforcing plate 54 is secured to barrier plate 10 along the forward contact edge 56 thereof in the area between segment assemblies 46 and 48.

The segment assemblies 46 and 48 are disposed inwardly from the lateral edges 58 and 60 of plate 10. For this reason, recesses 62 and 64 extend laterally from the segment assemblies 46 and 48 and permit the plate 10 to be flush with roadway R when in the first position, as illustrated in FIG. 3. The recesses 62 and 64 preferably have a concrete surface, although steel or other similar materials may be used.

Figure 2:
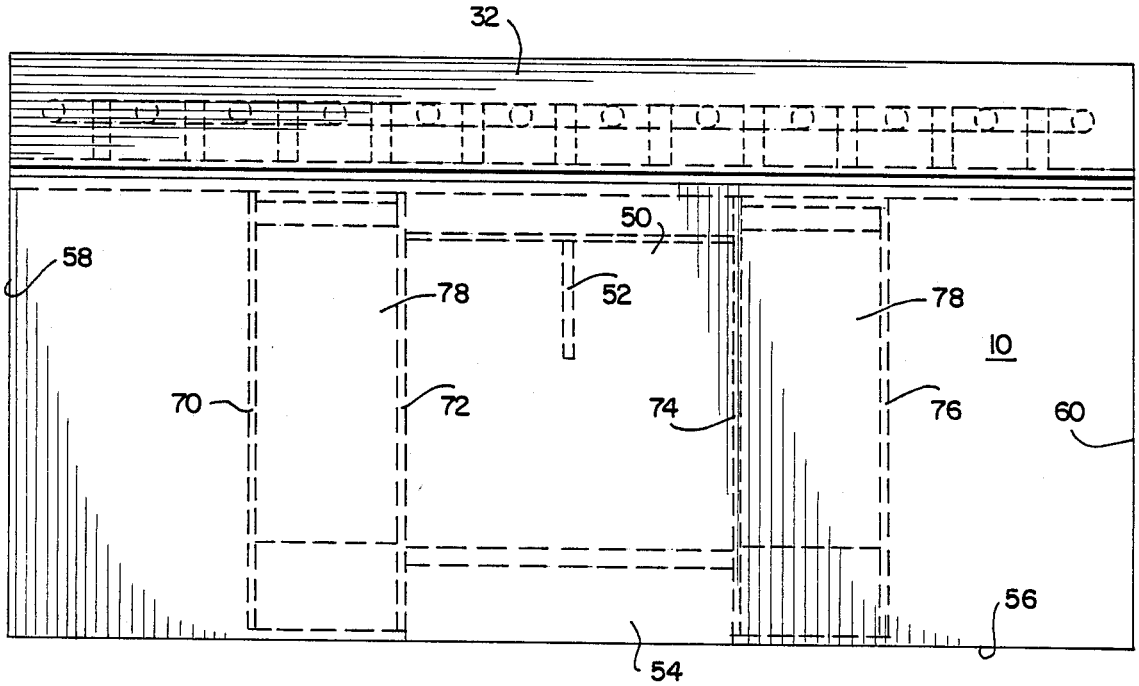
FIG. 2 is a top plan view of the barrier plate with portions shown in phantom.
Figure 4:
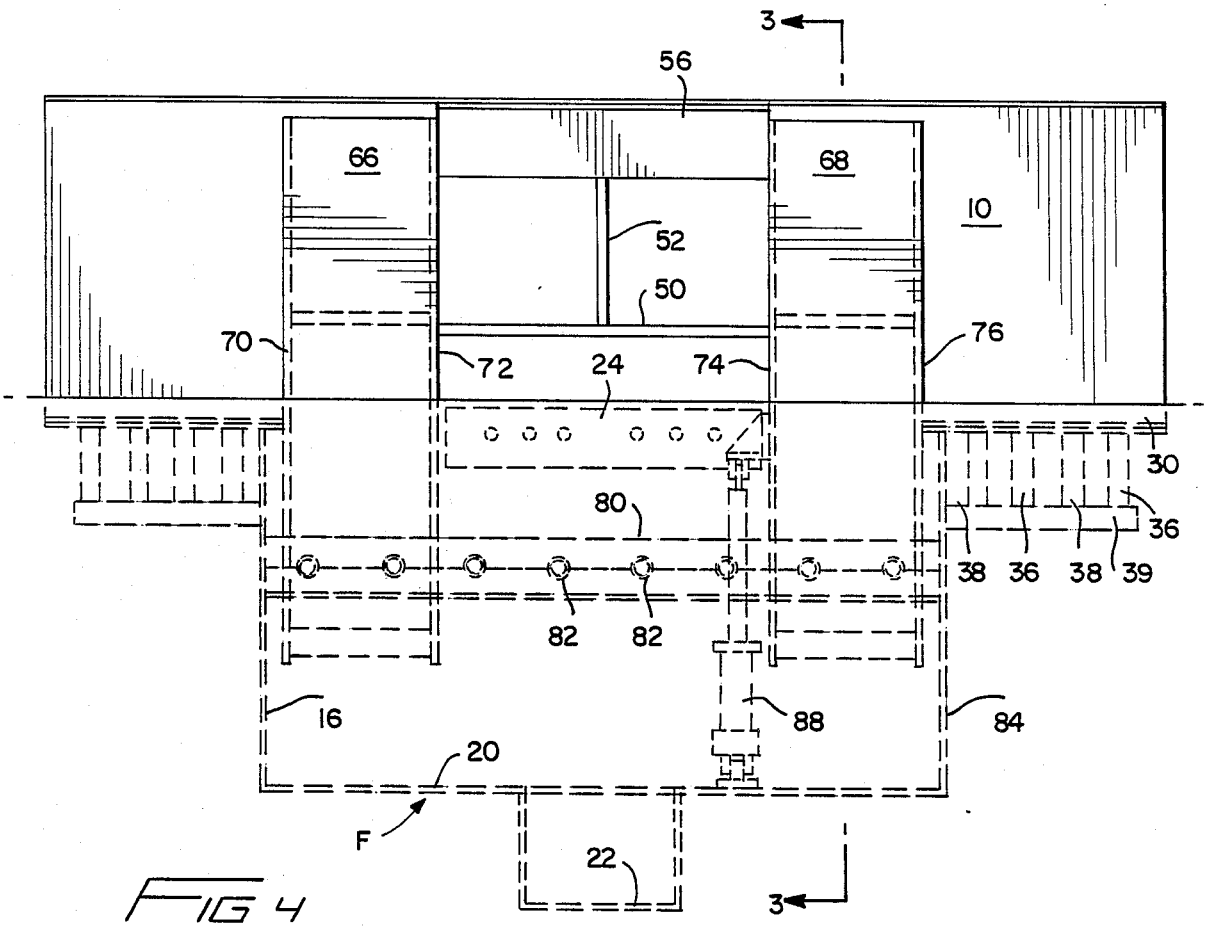
FIG. 4 is a front elevational view of FIG. 1 with portions shown in phantom; and, FIG. 5 is an enlarged cross-sectional view of the anchor means used to secure the barrier plate.

Each of the segment assemblies 46 and 48 has a face plate 66 and 68, respectively, upon which the vehicle impacts. Segment plates 70 and 72, as best shown in FIG. 4, are secured to face plate 66 and extend rearwardly therefrom and are secured to barrier plate 10. Similar segment plates 74 and 76 are secured to and extend rearwardly from face plate 68. The segment plates 70, 72, 74 and 76 are substantially identical in size, shape and purpose. It can be noted in FIG. 1 that the segment plates 72 and 76 span at least the distance between top 18 and barrier plate 10 and thereby prevent unauthorized access to the interior of barricade B when the plate 10 is in the raised position. Preferably, a reinforcing plate 78 extends between each of the side segment plates 70–72 and 74 and 76, as best shown in FIG. 2.

Front portion 14 has a generally L-shaped reinforced segment 80 positioned substantially midway bottom 20 and top 18, and extending between sides 16 and 84. A plurality of spaced tubular members 82 extend angularly upwardly and forwardly from segment 80. As best shown in FIG. 3, the concrete C fills the open-ended tubular members 82. The tubular members 82 extend in parallel relation and act as stabilizers which key the barricade B into the concrete C. The tubular members 82 extend angularly upwardly, thereby resisting any tendency for the barricade B to rotate or pivot about the brace 39 when impacted by a vehicle. The tubular members 82 furthermore prevent the barricade B from being removed from the concrete C.

Each of the face plates 66 and 68 is, as previously explained, secured to the associated segment plates 70–72 and 74–76, respectively. Each of the face plates 66 and 68, and the associated segment plates, has a generally L-shaped contact portion 86, only one of which is shown in FIG. 3.

Cylinder and piston assembly 88 is operably connected with bottom 20 and one of the segment plates, such as the segment plate 74 as best shown in FIGS. 3 and 4. Operation of the cylinder and piston assembly 88 causes the barrier plate 10 to pivot about shaft 30. Preferably, the cylinder and piston assembly 88 is hydraulically operated pursuant to the hydraulic system disclosed in copending application Ser. No. 043,977, filed Apr. 29, 1987, in the names of Ralph G. Nasatka and Michael Lippy for Hydraulic Vehicle Barricade and Method, the disclosure of which is incorporated herein by reference.

Pivoting of the barrier plate 10 to the second or raised position causes the contact portion 86 to engage the laterally extending segment 80, as illustrated in phantom line in FIG. 3. The contact portions 86 thereby provide a first element of a stop system, whereas the segment 80 provides the second element. The cylinder and piston assembly 88 pivots the plate 10 until such time as the contact portions 86 engage the segment 80, and thereby operably connect, the plate 10 with the front portion 14, so that the impact forces are distributed thereby to the concrete C.

The edge 56 is, in the second position, disposed approximately 34 inches above the surface of roadway R and top 18. An impacting vehicle will, therefore, tend to be funneled toward shaft 30 by the cooperative action of the barrier plate 10 and the central plate 50. The force resolution is such that the plate 10 attempts to further rotate on shaft 30, but is prevented from so rotating by engagement of contact portions 86 with segment 80. Furthermore, as noted, the barrier plate 10 is substantially in angular alignment with pipes 38 for likewise distributing impact force to the concrete C. The overall effect is, therefore, one wherein the impact force is initially received by the plate 10 and is then distributed to the frame and the surrounding concrete C. The plate 10 is therefore better able to absorb the impact without suffering massive structural damage, and without the plate 10 being ripped from the angle 22 and thereby rendered inoperative. Furthermore, plates 50 and 78, as best shown in FIG. 3, are oriented to absorb the force of impact, funnel same toward anchor assemblies 40 and thereby further reinforce plate 10.

The segment plates 72 and 74 are spaced sufficiently far apart so that they will engage a vehicle attempting to crash through the barricade B. The segment assemblies 46 and 48 will therefore engage laterally spaced portions of the vehicle and begin to demolish same, particularly if the speed is high. The center upright plate 52 will likewise engage the vehicle and cause further disintegration. The result is that the onrushing vehicle is stopped and the structural integrity of the barricade B maintained.

While this invention has been described as having a preferred design, it is understood that it is capable of further modifications uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A vehicle barricade, comprising:
(a) frame means having an open top and bottom, side, front and rear portions;
(b) a barrier plate pivotally associated with said frame means for being pivoted between a first position overlying said top and a second position angularly upwardly disposed relative to said top;
(c) means operably associated with said plate for pivoting said plate;
(d) first stop means extending from an carried by said plate;
(e) second stop means associated with said frame means engageable with said first stop means for preventing said plate from pivoting beyond said second position; (and),
(f) stabilizer means comprising a plurality of spaced parallel first members extending forwardly from said front portion for keying said frame means into the medium surrounding said frame means and thereby preventing said frame means from moving in the event said plate is impacted by a vehicle; and,
(g) each of said first members is tubular so that the medium surrounding the members fills same 2. The barricade of claim 1, wherein:
(a) said (stabilizer means including at least a) first members (member) extending angularly upwardly from said front portion.

3. The barricade of claim 1, wherein:
(a) (a plurality of spaced apart first members extending from said front portion,) said first members being substantially uniform spaced apart (and extending in parallel).

4. The barricade of claim 1, wherein:
(a) said stabilizer means operably connected to and extending from said second stop means.

5. The barricade of claim 1, wherein:
(a) means connecting said barrier plate with said front and rear portions when in said second position so that the impact of a vehicle is transferred to said frame means.

6. The barricade of claim 1, wherein:
(a) said frame means being positioned in a cementitious material surrounding said front, rear and side portions but not overlying said top.

7. The barricade of claim 1, wherein:
(a) said first members are secured to said frame means intermediate said open top and bottom portion.

8. The barricade of claim 1, wherein:
(a) first and second segment plates carried by and extending downwardly from said barrier plate, each of said segment plates disposed adjacent one of said side portions; and,
(b) face plate means secured to each of said segment plates.

9. The barricade of claim 8, wherein:
(a) third and fourth segment plates carried by and extending downwardly from said barrier plate, said third plate disposed adjacent said first plate and said fourth plate disposed adjacent said second plate; and,
(b) center plate means secured to and extending between said third and fourth plates and said center plate means being substantially parallel to said top when said barrier plate is in said second position.

10. The barricade of claim 9, wherein:
(a) first support plate means extending between and secured to said first and third plates an said first support plate means being generally parallel to said top when said barrier plate is in said second position; and,
(b) second support plate means extending between and secured to said second and fourth plates and said second support plate means being generally parallel to said top when said barrier plate is in said second position.

11. The barricade of claim 1, wherein:
(a) said barrier plate being generally rectangular and having a contact edge associated with said front potion and a pivot axis associated with said rear portion;
(b) shaft means extending along and secured to said barrier plate and defining said pivot axis; and,
(c) means operably associated with said rear portion and cooperating with said barrier plate for substantially preventing other than rotary movement of said shaft means.

12. The barricade of claim 11, wherein:
(a) an open top channel being operably connected to said rear portion proximate to said top;
(b) said shaft means seated in said channel; and,
(c) means extending from said channel for preventing removal of said shaft means therefrom.

13. The barricade of claim 12, wherein:
(a) a base plate secured to said channel and extending rearwardly therefrom, said base plate having an edge portion overlying said channel and said shaft means and providing said preventing means; and,
(b) anchor means extending from said channel and from said base plate for preventing movement thereof.

14. An underground barrier for controlling passage along a roadway, comprising:
(a) an excavated site disposed across a roadway to be controlled;
(b) frame means positioned within said site and including front, rear, side and bottom portions and having an open top generally aligned with the roadway and said frame means defining a chamber;
(c) stabilizer means extending angularly upwardly and forwardly from said front portion;
(d) cementitious material positioned within said site and disposed about said frame means for anchoring said frame means therein, said cementitious material cooperating with said stabilizer means for preventing upward movement of said frame means;
(e) a barrier plate pivotally secured to said rear portion and overlaying said top;
(f) means connected to said frame means and operably associated with said plate for pivoting said plate between a first position overlying said top in alignment with the roadway and a second position angularly upwardly disposed thereto for blocking the roadway;
(g) first stop means carried by said plate;

(h) second stop means secured to said front portion for being engaged by said first stop means and thereby preventing said plate from pivoting beyond said second position and for transferring impact forces from said plate to said frame means;

(i) first and second segment plates carried by said plate, each of said segment plates positioned adjacent one of said side portions and disposed within said chamber when said barrier plate is in said first position; and, (j) each of said segment plates having a contact portion providing said first stop means.

15. The barrier of claim 14, wherein:

(a) said stabilizer means extending from said second stop means; and, (b) said stabilizer means including a plurality of spaced tubular members and said members being filled with said cementitious material.

16. The barrier of claim 14, wherein:

(a) an open top channel being secured to said rear portion adjacent said top;

(b) shaft means secured to said barrier plate along an edge thereof and defining a pivot axis therefor;

(c) a base plate secured to said channel and having a portion overlying said shaft means for preventing said shaft means from being removed from said channel; and, (d) anchor means extending from and secured to said base and said channel and being disposed within said cementitious material.

17. The barrier of claim 14, wherein:

(a) third and fourth segment plates carried by said barrier plates, said third plate disposed adjacent said first plate and said fourth plate disposed adjacent said second plate; and, (b) first and second face plates, said first face plate secured to and carried by said first and third segment plates and said second face plate secured to and carried by said second and fourth segment plates.

18. The barrier of claim 17, wherein:

(a) a central plate extending between said third and fourth segment plates, said central plate being substantially parallel to the roadway when said barrier plate is in said second position:

(b) an upright plate extending between and secured to said, central plate and said barrier plate.

19. The barrier of claim 18, wherein:

(a) first and second reinforcing plates, said first reinforcing plate secured to and extending between said first and third plates;

(b) said second reinforcing plate extending between and secured to said second and fourth plates; and, (c) said central and first and second reinforcing plates being generally aligned for reinforcing said barrier plate and for transferring impact forces to said frame means.

20. A vehicle barricade, comprising:

(a) frame means having an open top and bottom, side, front and rear portions;

(b) a barrier plate pivotally associated with said frame means for being pivoted between a first position overlying said top and a second position angularly upwardly disposed relative thereto;

(c) means operably associated with said plate for causing pivoting thereof;

(d) first stop means extending from and carried by said plate;

(e) second stop means associated with said frame means engageable with said first stop means for preventing said plate from pivoting beyond said second position;

(f) stabilizer means extending upwardly from said front portion for preventing said frame means from moving in the event said plate is impacted by vehicle;

(g) first and second segment plate's carried by and extending downwardly from said barrier plate, each of said segment plates disposed adjacent one of said side portions;

(h) face plate means secured to each of said segment plates;

(i) third and fourth segment plates carried by and extending downwardly from said barrier plate, said third plate disposed adjacent said first plate and said fourth plate disposed adjacent said second plate; and, (j) center plate means secured to and extending between said third and fourth plates and said center plate means being substantially parallel to said top when said barrier plate is in said second position.

21. The barricade of claim 20, wherein:

(a) first support plate means extend between and are secured to said first and third plates and said first support plate means is generally parallel to said top when said barrier plate is in said second position; and, (b) second support plate means extend between and are secured to said second and fourth plates and said second support plate means is generally parallel to said top when said barrier plate is in said second position.

* * * * *